US008709110B2

(12) United States Patent
Hugentobler et al.

(10) Patent No.: US 8,709,110 B2
(45) Date of Patent: Apr. 29, 2014

(54) USE OF CAROTENOID (ESTER)S

(75) Inventors: Max Hugentobler, Arlesheim (CH); Steffen Ruf, Rheinfelden (CH); Bettina Wuestenberg, Basel (CH)

(73) Assignee: DSM IP Assets B.V., Heerlen (NL)

( * ) Notice: Subject to any disclaimer, the term of this patent is extended or adjusted under 35 U.S.C. 154(b) by 377 days.

(21) Appl. No.: 12/921,622

(22) PCT Filed: Mar. 11, 2009

(86) PCT No.: PCT/EP2009/052826

§ 371 (c)(1),
(2), (4) Date: Feb. 4, 2011

(87) PCT Pub. No.: WO2009/112506

PCT Pub. Date: Sep. 17, 2009

(65) Prior Publication Data

US 2011/0119995 A1 May 26, 2011

(30) Foreign Application Priority Data

Mar. 11, 2008 (EP) ..... 08004458
Aug. 27, 2008 (EP) ..... 08163083

(51) Int. Cl.
*C10L 1/18* (2006.01)

(52) U.S. Cl.
USPC ..... 44/388; 44/322; 44/413

(58) Field of Classification Search
USPC ..... 44/388, 322, 413
See application file for complete search history.

(56) References Cited

U.S. PATENT DOCUMENTS

| | | | | |
|---|---|---|---|---|
| 3,755,422 | A | 8/1973 | Morel | |
| 4,105,855 | A | 8/1978 | Schulz et al. | |
| 6,709,688 | B1 * | 3/2004 | Breivik et al. | 426/250 |
| 7,691,158 | B2 * | 4/2010 | Jordan et al. | 44/329 |
| 2005/0096477 | A1 | 5/2005 | Gloor et al. | |

(Continued)

FOREIGN PATENT DOCUMENTS

| | | |
|---|---|---|
| EP | 1 559 766 | 8/2003 |
| WO | WO 00/62625 | 10/2000 |

(Continued)

OTHER PUBLICATIONS

International Search Report for PCT/EP2009/052826, mailed Jul. 22, 2009.

(Continued)

*Primary Examiner* — Cephia D Toomer
(74) *Attorney, Agent, or Firm* — Nixon & Vanderhye P.C.

(57) ABSTRACT

The present invention relates to a composition comprising a) a substance selected from the group of astaxanthinmonoalkanoylesters, astaxanthindialkanoylesters, isozeaxanthin, isozeaxanthinmonoalkanoylesters, isozeaxanthindialkanoylesters and mixtures thereof; and b) a substance selected from the group of alkyl nitrates, nitrooxy esters of alkoxy substituted aliphatic alcohols and organic peroxides; as well as to a change in oxidation reactions of hydrocarbons, especially fuels, admixed to these compositions. The invention also relates to a composition comprising a) a compound selected from the group consisting of astaxanthinmonoalkanoylesters, astaxanthindialkanoylesters, iso-zeaxanthin, iso-zeaxanthinmonoalkanoylesters, iso-zeaxanthindialkanoylesters and mixtures thereof; and c) a fuel. Furthermore, the present invention relates to a composition comprising a) a compound selected from the group consisting of astaxanthinmonoalkanoylesters, astaxanthindialkanoylesters, isozeaxanthin, isozeaxanthinmonoalkanoylesters, isozeaxanthindialkanoylesters and mixtures thereof; and b) a compound selected from the group of alkyl nitrates, nitrooxy esters of alkoxy substituted aliphatic alcohols, organic peroxides and mixtures thereof; and d) a stabilizing compound; and e) optionally a solvent.

35 Claims, 2 Drawing Sheets

(56) References Cited

U.S. PATENT DOCUMENTS

| | | | |
|---|---|---|---|
| 2005/0186298 | A1 | 8/2005 | Johannisbauer et al. |
| 2007/0110881 | A1 | 5/2007 | Gloor et al. |
| 2008/0044475 | A1 | 2/2008 | Olvera et al. |
| 2008/0311267 | A1 | 12/2008 | Leigh et al. |

FOREIGN PATENT DOCUMENTS

| | | |
|---|---|---|
| WO | WO 03/066583 | 8/2003 |
| WO | WO 2004/039991 | 5/2004 |
| WO | WO 2005/003263 | 1/2005 |
| WO | WO 2006/125591 | 11/2006 |
| WO | WO 2009/027499 | 3/2009 |

OTHER PUBLICATIONS

Written Opinion of the International Searching Authority for PCT/EP2009/052826, mailed Jul. 22, 2009.

* cited by examiner (2a)

(2b)

(2c)

(2d)

USE OF CAROTENOID (ESTER)S

This application is the U.S. national phase of International Application No. PCT/EP2009/052826 filed 11 Mar. 2009, which designated the U.S. and claims priority to EP Application No. 08004458.9 filed 11 Mar. 2008; and EP Application No. 08163083.2 filed 27 Aug. 2008, the entire contents of each of which are hereby incorporated by reference.

FIELD OF THE INVENTION

The present invention relates to a composition comprising
a) a substance selected from the group of astaxanthinmonoalkanoylesters, astaxanthindialkanoylesters, isozeaxanthin, isozeaxanthinmonoalkanoylesters and isozeaxanthindialkanoylesters and mixtures thereof and
b) a substance selected from the group of alkyl nitrates, nitrooxy esters of alkoxy substituted aliphatic alcohols, organic peroxides and mixtures thereof.

The invention also relates to a change in oxidation reactions of hydrocarbons, especially of fuels, admixed to these compositions.

Moreover, the present invention relates to a composition comprising
a) a compound selected from the group consisting of astaxanthinmonoalkanoylesters, astaxanthindialkanoylesters, isozeaxanthin, iso-zeaxanthinmonoalkanoylesters, iso-zeaxanthindialkanoylesters and mixtures thereof and
c) a fuel.

Furthermore, the present invention relates to a composition comprising
a) a compound selected from the group consisting of astaxanthinmonoalkanoylesters, astaxanthindialkanoylesters, isozeaxanthin, isozeaxanthinmonoalkanoylesters, isozeaxanthindialkanoylesters and mixtures thereof and
b) a compound selected from the group consisting of alkyl nitrates, nitrooxy esters of alkoxy substituted aliphatic alcohols, organic peroxides and mixtures thereof and
d) a stabilizing compound; and
e) optionally a solvent. (A solvent is present if needed to increase the solubility in the fuel.)

Such a composition comprising compounds a), b) and d) or a), b), d) and e) may be used as fuel additive.

BACKGROUND OF THE INVENTION

Fuel efficiency can be improved by adding additives to hydrocarbons. Several patents have aimed to enhance the efficiency of fuel combustion with additives that contain carotenoids, e.g. U.S. Pat. No. 6,638,324.

There still is a need for compositions that improve the oxidation of hydrocarbons, especially the oxidation of fuels.

SUMMARY OF THE INVENTION

The invention relates to a composition comprising
a) a substance selected from the group of astaxanthinmonoalkanoylesters (see FIGS. 1: 1*b* and 1*c*), astaxanthindialkanoylesters (see FIG. 1: 1*d*), isozeaxanthin (see FIG. 2: 2*a*), isozeaxanthinmonoalkanoylesters (see FIGS. 2: 2*b* and 2*c*) and isozeaxanthindialkanoyl-esters (see FIG. 2: 2*d*) and mixtures thereof; and
b) a substance selected from the group of alkyl nitrates, nitrooxy esters of alkoxy substituted aliphatic alcohols, organic peroxides and mixtures thereof.

The invention also relates to a method of oxidizing a hydrocarbon, comprising bringing the hydrocarbon in contact with compound(s) a) and b) ("the composition of the present invention") and oxidizing at least part of the hydrocarbon.

The invention further relates to a mixture of the composition according to the present invention with a fuel, especially with a diesel fuel.

Moreover, the present invention relates to a composition comprising
a) a compound selected from the group consisting of astaxanthinmonoalkanoylesters, astaxanthindialkanoylesters, isozeaxanthin, iso-zeaxanthinmonoalkanoylesters, iso-zeaxanthindialkanoylesters and mixtures thereof; and
c) a fuel.

The composition of compound(s) a) and c) may further comprise a compound b) as defined above.

Furthermore, the present invention relates to a composition comprising
a) a compound selected from the group consisting of astaxanthinmonoalkanoylesters, astaxanthindialkanoylesters, isozeaxanthin, isozeaxanthinmonoalkanoylesters, isozeaxanthindialkanoylesters and mixtures thereof; and
b) a compound selected from the group of alkyl nitrates, nitrooxy esters of alkoxy substituted aliphatic alcohols, organic peroxides and mixtures thereof; and
d) a stabilizing compound as defined below; and
e) optionally a solvent. (A solvent is present if needed to increase the solubility in the fuel.)

Surprisingly it was found that the esters according to the present invention and thus also compositions containing it showed better solubility in fuel additives than isomixtene. That means that the fuel additives can be prepared with less solvent.

BRIEF DESCRIPTION OF DRAWINGS

FIGS. (1*a*-1*e*) show Astaxanthin as well its derivatives.

FIGS. (2*a*-2*d*) show Isozeaxanthin as well as its derivatives.

DETAILED DESCRIPTION OF THE PREFERRED EMBODIMENT

The term "a substance"/"a compound" encompasses the situation that at least one substance/compound is present meaning one or more substance(s)/compound(s) may be present. This applies for all compounds a) to e).

Substance/Compound a)

Figure 1:
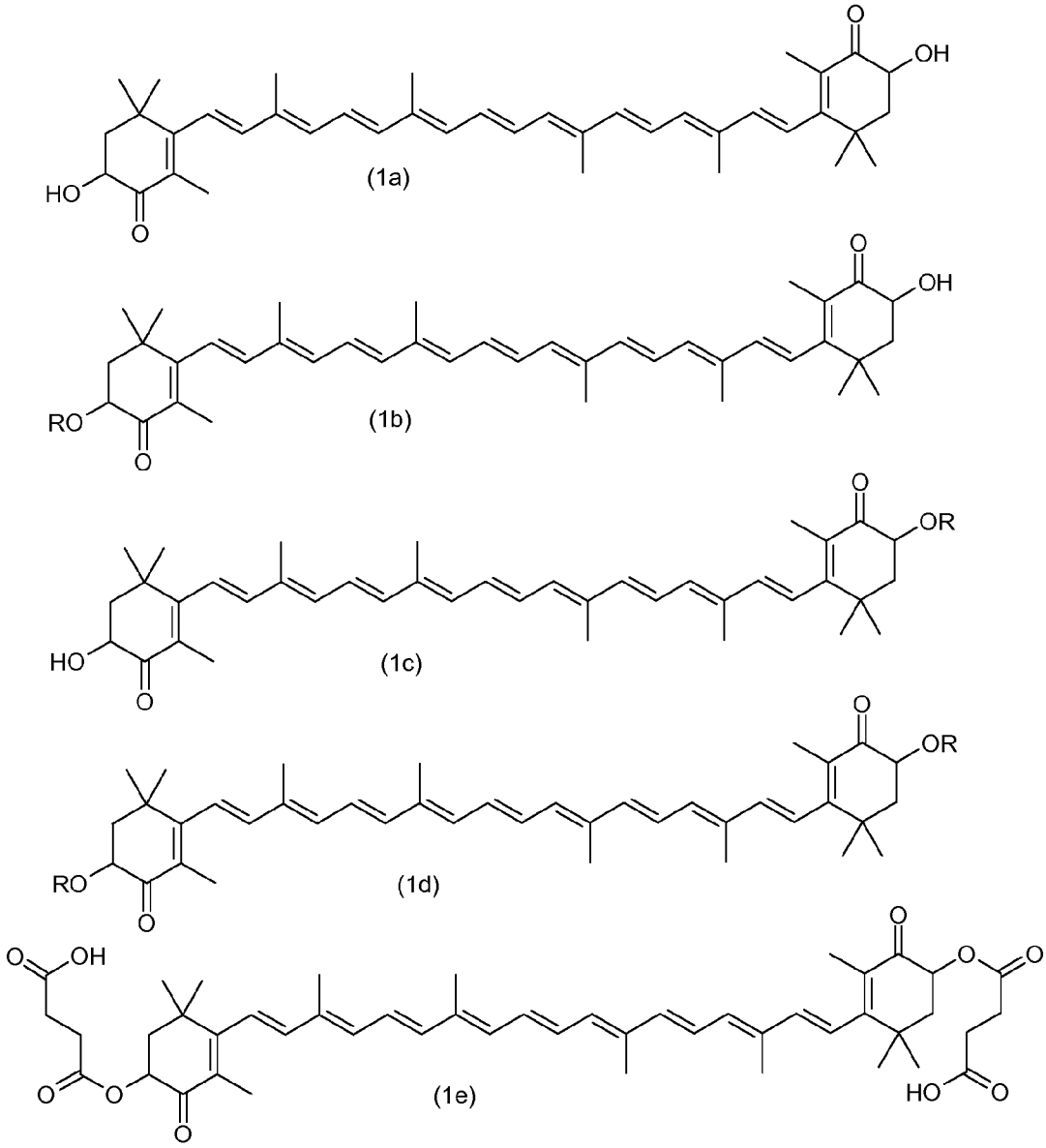
Figure 2:
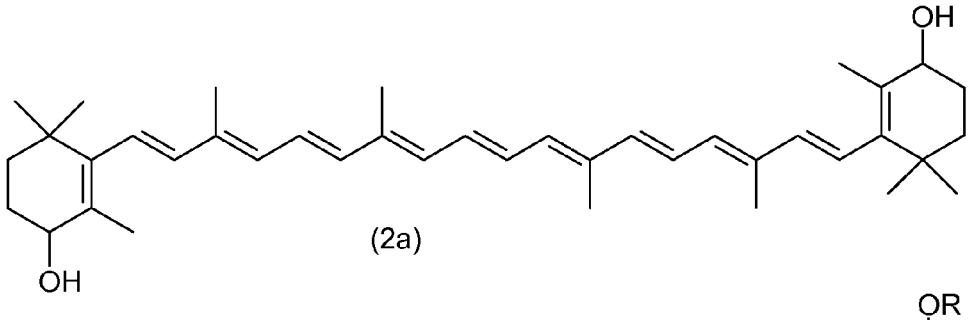
Figure 2:
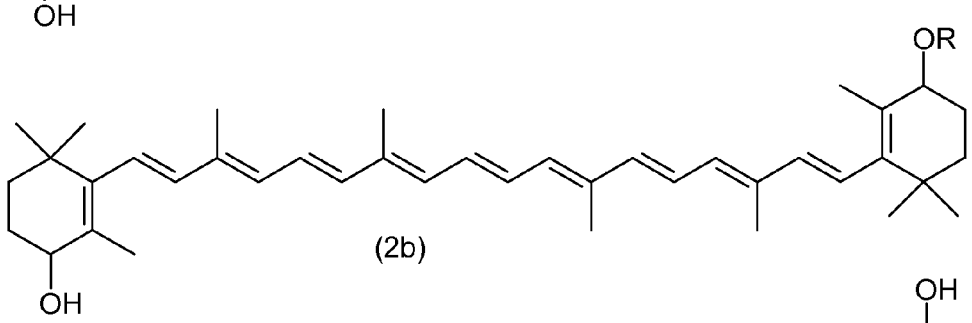
Figure 2:
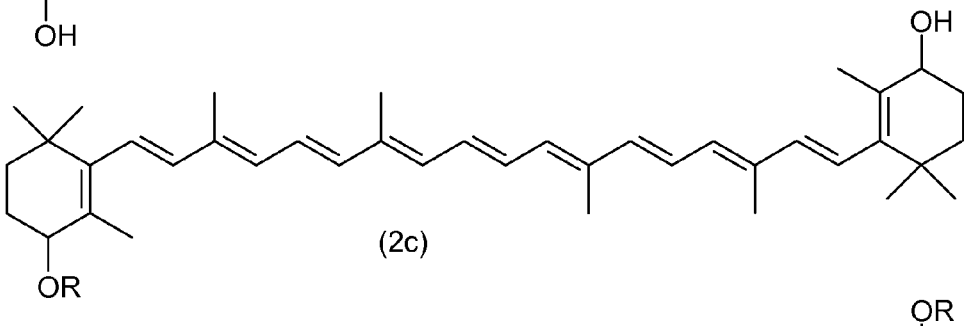
Figure 2:
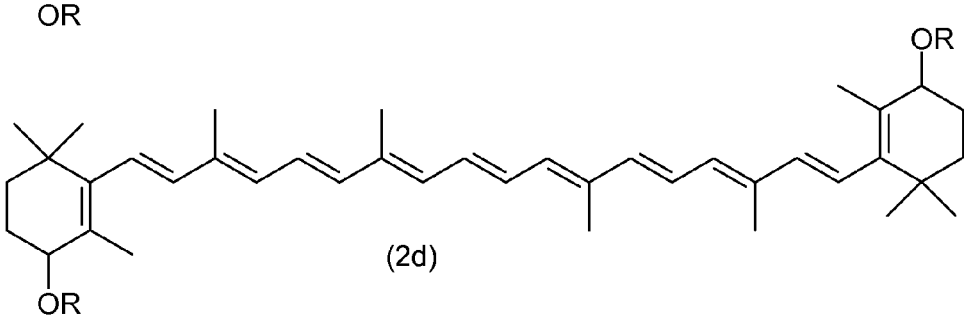

Astaxanthin (see FIG. 1: 1*a*) and isozeaxanthin (see FIG. 2: 2*a*) as well as their derivatives are known per se. In one embodiment of the invention a compound a) is selected from the group of astaxanthinmonoalkanoylester, astaxanthindialkanoylester, isozeaxanthinmonoalkanoylester and isozeaxanthindialkanoylester. Isozeaxanthin can also be used in that embodiment, as well as any mixture thereof.

Astaxanthin (di)esters may be prepared according to any method known to the person skilled in the art. The same applies for the manufacture of isozeaxanthin (di)esters.

A preferred method of making astaxanthinmonoalkanoylesters and astaxanthin-dialkanoylesters is described in U.S. Pat. No. 7,253,297.

These esters include astaxanthin-diethyldicarbonate, astaxanthin-diethyldioxalate, astaxanthin-di(N-acetylglycinate), astaxanthin-dimaleinate, astaxanthin-disuccinate (see FIG. 1: 1*e*), astaxanthin-dimethyldisuccinate, astaxanthin-diethyldisuccinate, asta-xanthin-diethyldiglycinedicarbamate, astaxanthin-dinicotinate, astaxanthin-di-methioninedicarbamate, astaxanthin-diacetyldiglycolate, astaxanthin-diphenyl-alaninedicarbamate, astaxanthindiethyldifumarate, astaxanthin-di(2-furoate), asta-xanthin-dimethyldimalonate, astaxanthin-di(3-methylthiopropionate), astaxanthin-dimethoxyacetate, astaxanthin-di-[(2-thienyl)acetate], astaxanthin-dilactate and astaxanthin-di(acetylmandelate).

These esters are exemplified for the astaxanthin molecule, but they can all be synthesized and used for the isozeaxanthin molecule as well.

Preferred examples of astaxanthindialkylesters, as well as of isozeaxanthinesters are the esters of astaxanthin and isozeaxanthin, respectively, with $C_1$-$C_{32}$ (preferably $C_{2-25}$, more preferably $C_{2-20}$, most preferably $C_{2-12}$) aliphatic mono- or di-acids, with $C_1$-$C_{32}$ (preferably $C_{2-25}$, more preferably $C_{2-20}$, most preferably $C_{2-12}$) unsaturated mono- or di-carboxylic acids, whereby the acids may be linear or branched or cyclic, and with benzoic acid. Most preferred are the diesters of astaxanthin and isozeaxanthin, respectively, with acetic acid, propionic acid, succinic acid and hexanoic acid: i.e. astaxanthin diacetate, astaxanthin dipropionate, astaxanthin dialkyl disuccinate, astaxanthin disuccinic acid (=astaxanthin disuccinate), astaxanthin dihexanoate, isozeaxanthin diacetate, isozeaxanthin dipropionate, isozeaxanthin dialkyl disuccinate, isozeaxanthin disuccinic acid, isozeaxanthin dihexanoate.

Examples of aliphatic mono-acids are acetic acid, propionic acid and hexanoic acid.

Examples of aliphatic di-acids are oxalic acid, succinic acid and malonic acid.

Examples of unsaturated dicarboxylic acids are maleinic acid and fumaric acid.

In another embodiment (the esters of the isozeaxanthin molecule) isozeaxanthin esters can be made from isozeaxanthin and acids, acid anhydrides or acid chlorides according to processes known to the person skilled in the art. Most preferred embodiments include the esters of isozeaxanthin with $C_2$-, $C_3$-, $C_4$-, $C_5$-, $C_6$-aliphatic acids and/or benzoic acid, acid anhydrides or acid chlorides.

In the compositions of the present invention enantiomerically pure astaxanthin mono- and di-esters, as well as enantiomerically pure isozeaxanthin mono- and diesters as well as enantiomerically pure isozeaxanthin may be used as well as any mixture of them including the racemate.

Besides all-E-astaxanthin (di)esters and all-E-isozeaxanthin (di)esters and all-E-isozeaxanthin all other stereoisomers (mixed E/Z-isomers) may be used.

The compound a) may be stabilized with tocopherol and/or tocopherol acetate, preferably with less than 10% by weight (wt.-%) of tocopherol and/or tocopherol acetate based on the weight of compound a), more preferably between 0.1% and 5 wt. % of tocopherol and/or tocopherol acetate, most preferably between 0.5 and 3 wt. % of tocopherol and/or tocopherol acetate.

The compound a) may also be mixed with synthetic or natural β-carotene, especially with synthetic β-carotene. Such synthetic β-carotene consisting of cis and trans stereoisomers is e.g. commercially available under the product name "isomixtene" from DSM Nutritional Products Ltd (Kaiseraugst, Switzerland). Preferably such synthetic β-carotene contains from about 89 weight-% to about 98.6 weight-% all-trans β-carotene and about 1.4 weight-% to about 11 weight-% of a mixture of cis β-carotene isomers (especially the 13Z-β-carotene isomer).

Substance/Compound b)

Alkyl nitrates are alkyl nitrates or cycloalkyl nitrates having up to about 25 carbon atoms, preferably from 1 to 12 carbon atoms, more preferably from 2 to 10 carbon atoms. The alkyl group may be either linear or branched. The cycloalkyl nitrates may also be substituted with linear or branched alkyl. Specific examples of nitrate compounds suitable for use in preferred embodiments include, but are not limited to, the following: methyl nitrate, ethyl nitrate, n-propyl nitrate, isopropyl nitrate, allyl nitrate, n-butyl nitrate, isobutyl nitrate, sec-butyl nitrate, tert-butyl nitrate, n-amyl nitrate, isoamyl nitrate, 2-amyl nitrate, 3-amyl nitrate, tert-amyl nitrate, n-hexyl nitrate, 2-ethylhexyl nitrate, n-heptyl nitrate, sec-heptyl nitrate, n-octyl nitrate, sec-octyl nitrate, n-nonyl nitrate, n-decyl nitrate, n-dodecyl nitrate, cyclopentylnitrate, cyclohexylnitrate, methylcyclohexyl nitrate, isopropylcyclohexyl nitrate, and the nitrooxy esters of alkoxy substituted aliphatic alcohols, such as 1-methoxypropyl-2-nitrate, 1-ethoxypropyl-2 nitrate, 1-isopropoxy-butyl nitrate, 1-ethoxylbutyl nitrate and the like. Preferred alkyl nitrates are ethyl nitrate, propyl nitrate, amyl nitrates, and hexyl nitrates. Other preferred alkyl nitrates are mixtures of primary amyl nitrates or primary hexyl nitrates. By primary is meant that the nitrate functional group is attached to a carbon atom which is attached to two hydrogen atoms. Examples of primary hexyl nitrates include n-hexyl nitrate, 2-ethylhexyl nitrate (2-EHN), 4-methyl-n-pentyl nitrate, and the like. The preparation of the nitrate esters may be accomplished by any of the commonly used methods: such as, for example, esterification of the appropriate alcohol, or reaction of a suitable alkyl halide with silver nitrate.

In many embodiments of the invention 2-ethylhexyl nitrate can make the best contribution to the invention.

It should be understood that pure alkyl nitrates are desired but that mixtures of alkyl nitrates and different purity grade are also suitable. Desirably, many different compositions are made, each having a different alkyl nitrate or more than one alkyl nitrate and/or proportions thereof relative to the compound a), which can be processed under an inert atmosphere, and these compositions are evaluated for their physical properties in different environmental conditions.

Organic peroxides are molecules having an oxygen-oxygen single bond (R—O-β-R'). When the other oxygen bears a hydrogen atom it is called a hydroperoxide (R—O—O—H). In one embodiment of the invention methyl ethyl ketone peroxide is used. A further example is di-t-butyl peroxide.

In the embodiment of the invention the compound b) is added to compound a) in a solvent. In other embodiments variations in the order of addition can be made.

Furthermore compound a) may also be first added to a fuel followed by compound b) or vice versa. Thus, the present invention is also directed to:

a composition comprising

- a compound selected from the group consisting of astaxanthinmonoalkanoylesters, astaxanthindialkanoylesters, iso-zeaxanthin, iso-zeaxanthinmonoalkanoylesters, iso-zeaxanthindialkanoylesters and mixtures thereof; and
- a fuel.

In one embodiment of the invention a particularly useful addition to the composition can include hydrocarbons.

The composition of the invention has many useful applications. In one embodiment of the invention, the composition can be added to different sorts of fuels to form a mixture.

Compound c)

The term "fuel" encompasses transportation fuels such as low-emission diesel, biodiesel, two-stroke oil, marine bunker fuel, gasoline and jet fuel and stationary-source fuels such as residual fuel oil, low emission diesel and coal.

As in the state of the art (in example U.S. Pat. No. 6,638,324) the composition can be added to fuels, especially to diesel fuels. It is not important to the invention, if the diesel fuel is selected from biodiesel or from petrochemical based diesel or others.

Petrochemical based diesel fuel, or simply diesel, is a specific fractional distillate of fuel oil (mostly petroleum). The term typically refers to fuel that has been processed from petroleum, but increasingly, alternatives such as biodiesel or biomass to liquid (BTL) or gas to liquid (GTL) diesel that are not derived from petroleum are being developed and adopted.

As described, for example, on the website of the National Biodiesel Board (www.biodiesel.org), biodiesel is a product that may comprise mono-alkyl esters of long chain fatty acids derived from vegetable oils or animal fats. Biodiesel may be produced by acid or base-catalyzed transesterification of the oil with an alcohol. Although methanol is commonly used as the alcohol, other alcohols may also be suitable.

Biodiesel may be blended with petroleum diesel for use in motor vehicles. The blends are commonly described as "BXX", where XX is the percent biodiesel in the blend. B20, for example, is 20% biodiesel, 80% conventional diesel. B100 is 100% biodiesel. The term biodiesel is technically the pure fuel produced by the transesterification process, where the biodiesel is conventional biodiesel. The blends are more properly described as BXX. Although B20 is commonly described as "biodiesel", the term B20 may be preferred to distinguish over pure biodiesel, B100.

A wide spread diesel fuel, which is useful to be included into the mixture, is No. 2 diesel fuel.

The ratio between the composition of the invention (compounds a) and b)) and the fuel, particularly the diesel fuel can vary widely. In certain embodiments of the invention it is advantageous to mix both constituents in a ratio of composition to fuel, particularly to diesel fuel, between 1:10.000.000 and 1:1000.

The diesel fuel may be used for operating any transportation vehicle like cars, buses, motorcycles and ships, i.e. for any two-strike engine or four cycle engine, as well as for any thermic power plant.

In one embodiment of the invention the mixtures can be formulated by the following method. Under an inert atmosphere, (e.g., nitrogen, helium, or argon) the composition containing the compound a), f.e. astaxanthin dialkyl disuccinate, is dissolved in a solvent (liquid hydrocarbon carrier) such as toluene with heating and stirring. After cooling to ambient temperature compound b) and optionally compound d) are added. The resulting mixture is then added to the fuel.

As shown in examples, emissions from oxidation of hydrocarbons and the composition of the invention may be lower than emissions that do not comprise the compositions of the present invention.

Compound d)

The compositions according to the present invention may further comprise a stabilizing component. This component may be selected from the group consisting of: 2,2,4-trimethyl-6-ethoxy-1,2-dihydroquinoline; ethoxyquinoline; 6-ethoxy-2,2,4-trimethyl-1H-quinoline, 2-tert-butylphenol; 2,6-di-tert-butylphenol; 2-tert-butyl-4-n-butylphenol; 2,4,6-tri-tert-butylphenol; 2,6-di-tert-butyl-4-n-butylphenol; 2,6-di-t-butyl-4-methyl-phenol (=BHT); 2(3)-tert-butyl-4-methoxyphenol (=BHA); 2,2'-methylene-bis(6-t-butyl-4-methylphenol); n-octadecyl 3-(3,5-di-t-butyl-4-hydroxyphenyl) propionate; 1,1,3-tris(3-t-butyl-6-methyl-4-hydroxyphenyl) butane; pentaerythrityltetrakis[3-(3,5-di-t-butyl-4-hydroxyphenyl)propionate]; di-n-octadecyl(3,5-di-t-butyl-4-hydroxybenzyl)-phosphonate; 2,4,6-tris(3,5-di-t-butyl-4-hydroxybenzyl) mesitylene; tris(3,5-di-t-butyl-4-hydroxybenzyl)isocyanurate; N,N'-diphenylphenylenediamine; p-octyldiphenylamine; p,p-dioctyldiphenylamine; N-phenyl-1-naphthylamine; N-phenyl-2-naphthylamine; N-(p-dodecyl)phenyl-2-naphthylamine; di-1-naphthylamine; and di-2naphthylamine; phenothazines; N-alkylphenothiazines; imino(bisbenzyl); 6-(t-butyl)phenol; 4-methyl-2,6-di-(t-butyl)phenol; 4,4'-methylenebis(-2,6-di-(t-butyl)phenol); a diphenylamine and a dinaphthylamine.

Compound e)

Other components that can be added to some embodiments of the inventions include solvents. Many solvents are known to the person of skill. In one embodiment of the invention an aromatic solvent can be used. Examples include benzene, toluene and (m-, p-, o-)xylene and related solvents, as well as mixtures thereof. In one embodiment toluene can be advantageously used.

In another embodiment of the invention the solvent can comprise non-aromatic solvents such as aliphatic solvents like alkanes and alkanones. Examples include hexane, heptane, octane, nonane, decane, cyclohexane, and related solvents, as well as mixtures thereof.

It is also possible to use mixtures of (different) aromatic and non-aromatic solvents like the mixture of toluene and hexane.

An embodiment of the present invention is a composition comprising a) a compound selected from the group consisting of astaxanthinmonoalkanoylesters, astaxanthindialkanoylesters, isozeaxanthinmonoalkanoylesters, isozeaxanthindi-alkanoylesters and mixtures thereof especially selected from the group consisting of astaxanthin dimethyldisuccinate, astaxanthin diacetate, and isozeaxanthin diacetate and mixtures thereof and b) 2-ethylhexyl nitrate and/or di-t-butyl peroxide; and d) a stabilizing compound, preferably selected from the group consisting of 6-ethoxy-2,2,4-trimethyl-1H-quinoline, 2,6-di-t-butyl-4-methylphenol (=BHT) and 2(3)-tert-butyl-4-methoxyphenol (=BHA) and mixtures thereof; and e) toluene.

Another embodiment of the present invention is a composition comprising a) a compound selected from the group consisting of astaxanthinmonoalkanoylesters, astaxanthindialkanoylesters, isozeaxanthinmonoalkanoylesters, isozeaxanthindi-alkanoylesters and mixtures thereof; especially selected from the group consisting of astaxanthin dimethyldisuccinate, astaxanthin diacetate, and isozeaxanthin diacetate and mixtures thereof; and b) 2-ethylhexyl nitrate; and d) 6-ethoxy-2,2,4-trimethyl-1H-quinoline (EMQ); and e) optionally toluene.

A further embodiment of the present invention is a composition comprising a) a compound selected from the group consisting of astaxanthinmonoalkanoylesters, astaxanthindialkanoylesters, isozeaxanthinmonoalkanoylesters, isozeaxanthindi-alkanoylesters and mixtures thereof; especially selected from the group consisting of astaxanthin dimethyldisuccinate, astaxanthin diacetate, and isozeaxanthin diacetate and mixtures thereof; and b) 2-ethylhexyl nitrate; and d) 6-ethoxy-2,2,4-trimethyl-1H-quinoline (EMQ); and e) toluene.

Also an embodiment of the present invention is a composition comprising a) a compound selected from the group consisting of astaxanthinmonoalkanoylesters, astaxanthindialkanoylesters, isozeaxanthinmonoalkanoylesters, isozeaxanthindi-alkanoylesters and mixtures thereof; especially selected from the group consisting of astaxanthin dimethyldisuccinate, astaxanthin diacetate, and isozeaxanthin diacetate and mixtures thereof; and b) 2-ethylhexyl nitrate.

Further Components

In another embodiment components selected from the group of long chain fatty acids, long chain fatty esters, and any combination thereof can be added to the compositions according to the invention. As used herein, the term "long chain" refers to a molecule with a carbon chain of about 16 carbons atoms or greater, especially of about 16-50 C atoms. The long chain fatty acids or esters may also comprise, for example, meadow foam oil, jojoba oil, or mixtures thereof. Other oils that may comprise long chain fatty acids or esters may also be suitable. Synthetic long chain fatty acids or esters may also be suitable. Other components such as stabilizing compounds, or other components may be added as additional components.

The long chain fatty acids or esters and the solvent are optional components of the composition according to embodiments of the present invention. Components that may comprise long chain fatty acids or esters in addition to compounds a) and b) are preferred embodiments.

In one embodiment of the invention the composition may include a further constituent selected from the group consisting of a plant extract, a synthetic form of a plant extract, and mixtures thereof. A synthetic form of a plant extract, as that expression is used herein, refers to one or more synthetically produced compositions that naturally occur in plant extracts. The synthetic compositions may include, for example, xanthophylls, or chlorophylls.

Ignition Accelerators

In a preferred embodiment, other conventional ignition accelerators may be used as a further component of the composition of the invention. Conventional ignition accelerators may include, for example, but not limited to, hydrogen peroxide, benzoyl peroxide, di-tert-butyl peroxide (DTBP), cumene hydroperoxide, di-oleal peroxide, soybean hydroperoxide, and di-ethyl peroxide. Other organic peroxides and hydroperoxides may also be suitable. DTBP is an exemplary ignition accelerator.

In an embodiment, the composition according to embodiments of the present invention may comprise an alkyl nitrate in addition to a conventional ignition accelerator. In an embodiment, the compositions according to embodiments of the present invention may comprise both di-tert-butyl peroxide (DTBP) and 2-ethylhexyl nitrate (2-EHN). The 2-EHN may alternatively be added to the compositions of the invention separately from the other components.

Alternatively, another component may supplement the compound a) including, but not limited to, β-carotene; α-carotene; or additional carotenoids or food pigments from algae; zeaxanthin; cryptoxanthin; lycopene; lutein; astaxanthin and canthaxanthin; broccoli concentrate, spinach concentrate, tomato concentrate, kale concentrate, cabbage concentrate, brussels sprouts concentrate and phospholipids, green tea extract, milk thistle extract, curcumin extract, quercetin, bromelain, cranberry and cranberry powder extract, pineapple extract, pineapple leaves extract, rosemary extract, grape seed extract, *ginkgo biloba* extract, polyphenols, flavonoids, ginger root extract, hawthorn berry extract, bilberry extract, butylated hydroxytoluene, oil extract of marigolds, any and all oil extracts of carrots, fruits, vegetables, flowers, grasses, natural grains, leaves from trees, leaves from hedges, hay, any living plant or tree, and combinations or mixtures thereof.

Vegetable carotenoids are particularly preferred, including those containing lycopene, lutein, alpha-carotene, other carotenoids from carrots or algae, betatene, and natural carrot extract. In certain particularly preferred embodiments, a substitute for beta-carotene is present in an amount sufficient to yield an equivalent vitamin A activity as for a preferred quantity of beta-carotene. However, in other embodiments vitamin A activity may not be a preferred method for determining the quantity of substitute, or the substitute may not have an equivalent vitamin A activity.

The following components may be used in combination with compound a) in preferred embodiments: butylated hydroxytoluene, lycopene, lutein, all types of carotenoids, oil extract from carrots, beets, hops, grapes, marigolds, fruits, vegetables, palm oil, palm kernel oil, palm tree oil, bell pepper, cottonseed oil, rice bran oil, any plant that is naturally orange, red, purple, or yellow in color that is growing in nature, or any other material that may be a natural oxygen scavenger but yet remains organic in nature.

In one embodiment the invention relates to a method of oxidizing a hydrocarbon, comprising i) bringing the hydrocarbon in contact with compound a); and ii) bringing the hydrocarbon in contact with compound b); and iii) oxidizing at least part of the hydrocarbon.

Thus, compound a) and b) may be put together (simultaneously) to the hydrocarbon or separately successively. It may also be possible to first add compound b) and then to add compound a) to the hydrocarbon. Furthermore, the compounds a) and b) may first be mixed and then brought in contact with the hydrocarbon.

When compounds d) and e) are also present, it is also possible to first mix all components and then to add the mixture to the hydrocarbon, as well as to pre-mix some of the components and then to add them successively to the hydrocarbon. The order, in which the single compounds or premixes of them are added is not critical.

Hydrocarbons include all chemical compounds that consists only of the elements carbon (C) and hydrogen (H). Hydrocarbons contain a backbone consisting of carbon atoms, called a carbon skeleton with hydrogen atoms attached to that backbone. Hydrocarbons, which are combustible, are the main components of fossil fuels, which include petroleum, coal, and natural gas. Preferred hydrocarbons in the context of the invention are liquid at room temperature.

One form of oxidation, particularly useful in the context of the present invention, is combustion. Combustion is generally defined as the exothermic reaction of substances with oxygen.

The present invention may not only be directed to the combustion of diesel fuel, but also of natural fuel, petrol, crude oil and residual fuel.

EXAMPLE 1

Solubility of Carotenoid Esters

| Carotenoid (ester) | Solubility in toluene at 25° C. |
|---|---|
| Isomixtene (comparison example) | 0.56% |
| Isozeaxanthin-diacetate | 4.0% |
| Astaxanthin-dimethyldisuccinate | 5.2% |

The example shows that the solubility of isozeaxanthin (di)esters and astaxanthin (di)esters in toluene is better than the solubility of isomixtene.

That is beneficial for an application in diesel fuel.

The invention claimed is:

1. A composition comprising:

a) a compound selected from the group consisting of iso-zeaxanthin, iso-zeaxanthinmonoalkanoylesters, iso-zeaxanthindialkanoylesters and mixtures thereof; and c) a fuel.

2. The composition according to claim 1, further comprising a compound b) selected from the group consisting of alkyl nitrates, nitrooxy esters of alkoxy substituted aliphatic alcohols and organic peroxides.

3. A composition comprising:

a) a substance selected from the group consisting of iso-zeaxanthin, iso-zeaxanthinmonoalkanoylesters, iso-zeaxanthindialkanoylesters and mixtures thereof; and b) a substance selected from the group consisting of alkyl nitrates, nitrooxy esters of alkoxy substituted aliphatic alcohols and organic peroxides.

4. The composition of claim 2 wherein compound b) is an alkyl nitrate.

5. The composition of claim 1 further comprising a solvent.

6. A composition comprising:

a) a compound selected from the group consisting of isozeaxanthin, isozeaxanthinmonoalkanoylesters, isozeaxanthindialkanoylesters and mixtures thereof;

b) a compound selected from the group consisting of alkyl nitrates, nitrooxy esters of alkoxy substituted aliphatic alcohols, organic peroxides and mixtures thereof;

d) a stabilizing compound; and e) optionally a solvent.

7. The composition of claim 6, wherein a solvent is present and wherein the solvent comprises an aromatic solvent and/or an aliphatic solvent.

8. The composition of claim 1, further comprising a compound which is at least one selected from the group consisting of fatty acids and fatty esters each having a carbon chain of 16 carbon atoms or greater.

9. The composition of claim 1 wherein the compound a) is stabilized with tocopherol and/or tocopherol acetate.

10. The composition of claim 1 further comprising at least one stabilizing component selected from the group consisting of 2,2,4-trimethyl-6-ethoxy-1,2-dihydroquinoline; ethoxyquinoline; 6-ethoxy-2,2,4-trimethyl-1H-quinoline; 2-tert-butylphenol; 2,6-di-tert-butylphenol; 2-tert-butyl-4-n-butylphenol; 2,4,6-tri-tert-butylphenol; 2,6-di-tert-butyl-4-n-butylphenol; 2,6-di-t-butyl-4-methylphenol; 2-tert-butyl-4-methoxyphenol; 3-tert-butyl-4-methoxyphenol; 2,2'-methylene-bis(6-t-butyl-4-methylphenol); n-octadecyl 3-(3,5-di-t-butyl-4-hydroxy-phenyl) propionate; 1,1,3-tris(3-t-butyl-6-methyl-4-hydroxy phenyl) butane; pentaerythrityltetrakis[3-(3,5-di-t-butyl-4-hydroxyphenyl) propionate]; di-n-octadecyl(3,5-di-t-butyl-4-hydroxybenzyl) phosphonate; 2,4,6-tris(3,5-di-t-butyl-4-hydroxybenzyl) mesitylene; tris(3,5-di-t-butyl-4-hydroxybenzyl)isocyanurate; N,N'-diphenylphenylenediamine; p-octyldiphenylamine; p,p-dioctyldiphenylamine; N-phenyl-1-naphthylamine; N-phenyl-2-naphthylamine; N-(p-dodecyl)phenyl-2-naphthylamine; di-1-naphthylamine; di-2-naphthylamine; phenothazines; N-alkylphenothiazines; imino(bisbenzyl); 6-(t-butyl)phenol; 4,4'-methylenebis(-2,6-di-(t-butyl)phenol); diphenylamines and dinaphthylamines.

11. The composition of claim 3 comprising a hydrocarbon molecule.

12. The composition of claim 1, wherein the compound a) comprises an iso-zeaxanthindialkylester which is an ester of iso-zeaxanthin with a $C_1$-$C_{32}$ aliphatic acid.

13. A composition comprising:

a) a compound selected from the group consisting of astaxanthin monoalkanoylesters, astaxanthindialkanoylesters, isozeaxanthin monoalkanoylesters and isozeaxanthindialkanoylesters and mixtures thereof;

b) 2-ethylhexyl nitrate and/or di-t-butyl peroxide;

d) a stabilizing compound selected from the group consisting of 6-ethoxy-2,2,4-trimethyl-1H-quinoline, 2,6-di-t-butyl-4-methylphenol and 3-tert-butyl-4-methoxyphenol and mixtures thereof; and e) optionally toluene.

14. A method of oxidizing a hydrocarbon, comprising:

i) bringing the hydrocarbon in contact with a compound a) according to claim 1;

ii) bringing the hydrocarbon in contact with a compound b) selected from the group consisting of alkyl nitrates, nitrooxy esters of alkoxy substituted aliphatic alcohols and organic peroxides; and iii) oxidizing at least part of the hydrocarbon.

15. A mixture comprising a composition according to claim 3 and a fuel.

16. The mixture of claim 15, wherein the fuel is a diesel fuel.

17. The mixture of claim 16, wherein the diesel fuel is selected from the group consisting of biodiesel and petrochemical based diesel.

18. The mixture of claim 16, wherein the composition is present in an amount such that a ratio of the composition to diesel fuel is between 1:10,000,000 and 1:1,000.

19. The mixture of claim 16 wherein the diesel fuel comprises No. 2 diesel fuel.

20. A composition comprising:

a) a compound selected from the group consisting of isozeaxanthin monoalkanoylesters and isozeaxanthindialkanoylesters and mixtures thereof;

b) 2-ethylhexyl nitrate;

d) 6-ethoxy-2,2,4-trimethyl-1H-quinoline; and e) optionally toluene.

21. A composition comprising a) a compound selected from the group consisting of isozeaxanthin monoalkanoylesters and isozeaxanthindialkanoylesters and mixtures thereof; and b) 2-ethylhexyl nitrate.

22. The composition of claim 4 wherein compound b) is 2-ethylhexyl nitrate.

23. The composition of claim 7, wherein the solvent is at least one selected from the group consisting of hexane, heptane, octane, nonane decane, cyclohexane, benzene, toluene and xylene.

24. The composition of claim 9, wherein the compound a) is stabilized with less than 10% by weight of tocopherol and/or tocopherol acetate based on the weight of compound a).

25. The composition of claim 9, wherein the compound a) is stabilized with between 0.1% and 5 wt. % of tocopherol and/or tocopherol acetate.

26. The composition of claim 9, wherein the compound a) is stabilized with between 0.5 and 3 wt. % of tocopherol and/or tocopherol acetate.

27. The composition of claim 12, wherein the iso-zeaxanthindialkylester is an ester of iso-zeaxanthin with acetic acid, propionic acid, succinic acid or hexanoic acid.

28. The composition of claim 13, 20 or 21, wherein the compound a) comprises isozeaxanthin diacetate.

29. A composition comprising:

a compound selected from the group consisting of astaxanthindialkylesters, astaxanthinmonoalkanoylesters, astaxanthindialkanoylesters, iso-zeaxanthin, iso-zeaxanthindialkylesters, iso-zeaxanthinmonoalkanoylesters, iso-zeaxanthindialkanoylesters and mixtures thereof;

a fuel; and at least one fatty acid and/or fatty ester having a carbon chain of 16 carbon atoms or greater.

30. A composition comprising:

a compound stabilized with tocopherol and/or tocopherol acetate, wherein the compound is selected from the group consisting of astaxanthindialkylesters, astaxanthinmonoalkanoylesters, astaxanthindialkanoylesters, iso-zeaxanthin, iso-zeaxanthindialkylesters, iso-zeaxanthinmonoalkanoylesters, iso-zeaxanthindialkanoylesters and mixtures thereof; and a fuel.

31. The composition of claim 29 or 30, wherein the astaxanthindialkylester is an ester of astaxanthin with a $C_1$-$C_{32}$ aliphatic acid.

32. The composition of claim 29 or 30, wherein the astaxanthindialkyester is a diester of astaxanthin with acetic acid, propionic acid, succinic acid or hexanoic acid.

33. The composition of claim 29 or 30, wherein the iso-zeaxanthindialkylester is an ester of iso-zeaxanthin with a $C_1$-$C_{32}$ aliphatic acid.

34. The composition of claim 29 or 30, wherein the iso-zeaxanthindialkylester is an ester of iso-zeaxanthin with acetic acid, propionic acid, succinic acid or hexanoic acid.

35. The composition of claim 29 or 30, wherein the compound comprises astaxanthin diacetate or isozeaxanthin diacetate.

* * * * *